US006478001B1

(12) United States Patent
Burns et al.

(10) Patent No.: US 6,478,001 B1
(45) Date of Patent: Nov. 12, 2002

(54) CAM FOLLOWER WITH CLAMP

(75) Inventors: John Joseph Burns, Brighton; Cynthia Ann Greene, Rochester, both of NY (US); Shawn H. Russell, Bristol, CT (US)

(73) Assignees: Delph Technologies, Inc., Troy, MI (US); Okay Industries, Inc., New Britain, CT (US)

( * ) Notice: Subject to any disclaimer, the term of this patent is extended or adjusted under 35 U.S.C. 154(b) by 0 days.

(21) Appl. No.: 10/023,014

(22) Filed: Dec. 18, 2001

(51) Int. Cl.[7] ..... F01L 1/18

(52) U.S. Cl. ..... 123/90.41; 123/90.42; 74/559

(58) Field of Search ..... 123/90.39–90.47; 74/519, 559

(56) References Cited

U.S. PATENT DOCUMENTS 3,222,950 A * 12/1965 Winter, Jr. ..... 74/519
4,875,442 A * 10/1989 Akao et al. ..... 123/90.39
5,671,707 A * 9/1997 Purcell et al. ..... 123/90.37
6,293,168 B1 * 9/2001 Torlai et al. ..... 74/559

* cited by examiner

*Primary Examiner*—Weilun Lo
(74) *Attorney, Agent, or Firm*—Patrick M. Griffin

(57) ABSTRACT

A cam follower having a clamp disposed on at least one end thereof. The follower includes two opposing sidewalls interconnected by a lower pallet. A roller is rotatably mounted to and disposed between the sidewalls via needled or journal bearings or other rotatable connection known in the art. A clamp is disposed about an end of the follower to induce compression force in the pallet and possibly act as the valve guide walls. The clamp increases the stiffness of the follower and induces compressive stress in the pallet area thereby increasing fatigue life. The clamp could also increase the length of the valve guide walls for better stability during engine assembly.

9 Claims, 4 Drawing Sheets

CAM FOLLOWER WITH CLAMP

BACKGROUND OF THE INVENTION

1. Field of the Invention

The present invention is related to a cam follower and particularly to a roller follower having a clamp to induce a compression force in a lower pallet portion and/or possibly act as valve guide walls.

2. Description of the Related Art

Roller followers for opening valves in an over head camshaft in an internal combustion engine arrangement are known in the art. FIG. 1 depicts one such known device. The follower of FIG. 1 includes a substantially one-piece U-shaped body having two upstanding sidewalls interconnected by a bottom wall or pallet. A first end of the follower is adapted to receive an end of a lifter post or tappet on which the roller follower can pivot. A second end of the roller follower receives the upper end of a valve stem arrangement. A middle portion of the bottom wall or pallet is cut out to accommodate a roller rotatably disposed between the sidewalls for engaging an overhead cam. The valve stem extends upward from the cylinder head through a coiled compression spring. As the cam rotates, the cam engages the roller to cause the follower to pivot about the lifter/tappet thereby opening and closing the valve as the stem is displaced.

However, the roller follower devices of the prior art are susceptible to fatigue failure at the ends and particularly at the end of the roller follower adjacent the interface with the valve stem.

It is the object of the present invention to improve upon the cam follower designs of the related art and to provide a follower with a clamp to induce a compressive force on the lower pallet thereby increasing fatigue life and stiffness of the follower. Additionally, the side walls of the clamp may extend past the pallet to act as valve guide walls to improve stability during engine operation.

SUMMARY OF THE INVENTION

The present invention is directed to cam follower having a clamp disposed on at least one end. A one-piece stamped follower includes two opposing sidewalls interconnected by a lower pallet. A roller is rotatably mounted to and disposed between the sidewalls via needled or journal bearings or other rotatable connection known in the art. A clamp is disposed about an end of the follower to induce compression force in the pallet. The clamp increases the stiffness of the follower and induces compression forces in the pallet thereby increasing fatigue life and allows for long valve guide walls to help the roller finger follower from tipping over during engine assembly operations.

DESCRIPTION OF THE PREFERRED EMBODIMENT

Figure 1:
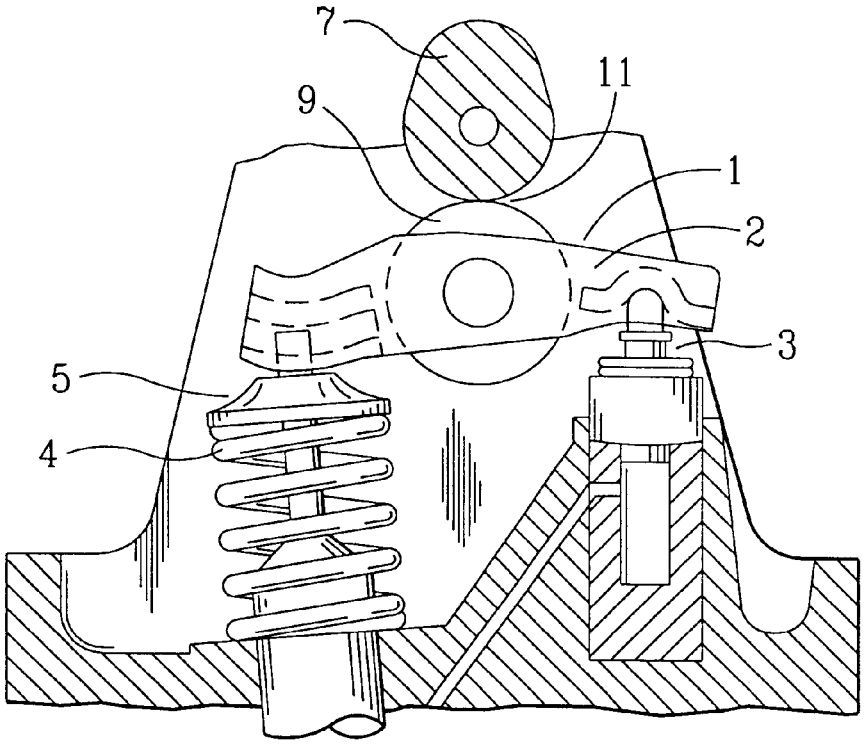
Fig. 1 Prior Art
FIG. 1. is a partial cross sectional view of a valve actuating mechanism of an overhead cam driven internal combustion engine with a cam follower according to the prior art.

To facilitate the understanding of the present invention, the prior art follower device will be described. FIG. 1 depicts a valve-actuating device incorporating a roller follower 1 of the prior art. A cam follower 1 is pivotally supported on a lifter post/tappet 3 and extends to engage a valve stem 5 of an internal combustion engine. A camshaft 7 is provided to pivot the cam follower 1 to displace the valve stem 5 between an open and closed position. The cam follower 1 is provided with a roller 9 to provide a rolling interface 11 between the camshaft 7 and the follower 1. As the camshaft 7 rotates, the cam follower 1 is forced to pivot downward about the lifter post/tappet 3 and force the valve stem 5 down to an open position. A coiled compression spring 4 is disposed about the valve stem 5 to bias the valve stem upward to a closed position. The camshaft 7 continuously rotates to open and close the valve stem 5 in a reciprocating manner. The lifter post/tappet 3 may be adjustable or hydraulically yielding to provide zero lash adjustment. Such arrangements are well known in the art.

Figure 2:
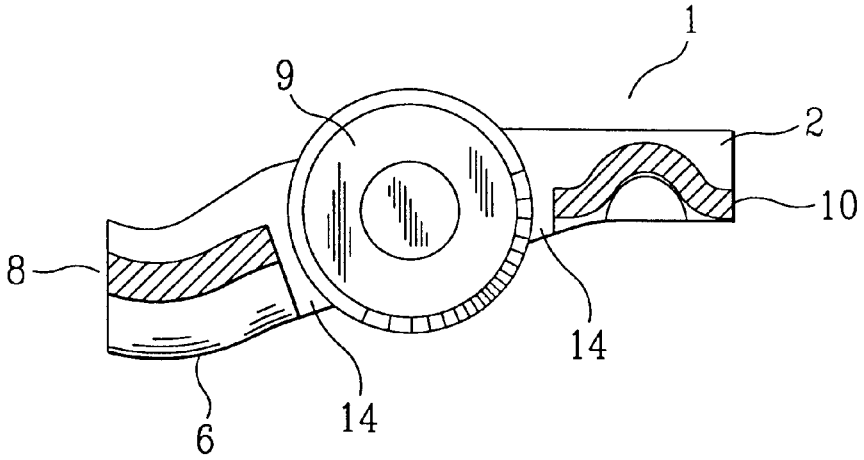
Fig. 2 Prior Art
FIG. 2 is an isolated partial cross sectional view of the cam follower of FIG. 1.

FIG. 2 is an isolated view of the cam follower 1 of FIG. 1. The cam follower 1 has a main body including a pair of spaced apart sidewalls 2 interconnected by a lower wall 6. The main body extends from a first end 10 and is adapted to be pivotally supported on the lifter post 3. The first end 10 has a recess to receive the upper end of the lifter post/tappet 3. The second end 8 preferably has a groove or elongated recess to receive and engage the upper end of the valve stem 5. An intermediate portion of the lower wall 6 has a cut out 14 to accommodate the roller 9 rotatably disposed between and mounted to the sidewalls 2. The roller 9 is rotatably mounted to the sidewalls 2 to engage the camshaft 7 and thus cause the pivotal movement of the follower 1 which in turn causes the reciprocating movement of the valve stem 5. The roller 9 may be mounted about an axle extending between the sidewalls 2. In such an arrangement bearings such as needle bearings or journal bearings (not shown) are disposed between the roller 9 and axle to facilitate rotation there between. As can be seen in FIG. 2, the roller 7 extends through the cut out 14 or opening and below the lower wall 6 of the main body. However, the present invention is not limited to such an embodiment. The lower wall may be substantially solid and possibly form an oil belly to facilitate lubrication of the roller 9. The roller 9 further extends upward beyond the upper portion of the sidewalls 2 to enable engagement with the camshaft 7.

The present invention improves upon the prior art roller follower 1 as described above. The cam follower 101 of the present invention is employed as in the aforementioned description of the prior art. That is, the cam follower 101 of the present invention is disposed in an overhead cam shaft internal combustion engine pivotally supported by a tappet to reciprocatingly open and close the valve stem. Therefore, only the specific structure of the cam follower 101 as it differs from the prior art will now be explained. However, it is to be understood that the cam follower 101 of the present invention may be employed in other valve actuating mechanisms than the aforementioned description.

Figure 3:
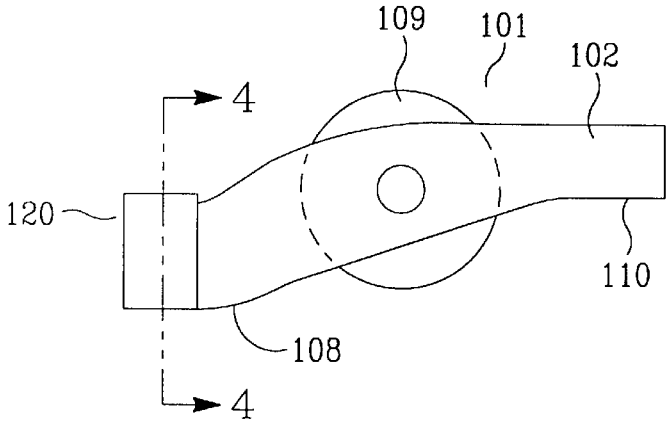
FIG. 3 is an isolated side view of the cam follower and clamp according to the present invention.

The roller follower 101 of the present invention includes a clamp 120 disposed about one end of the follower 101 to induce a compression force to the lower pallet 106. As can bee seen from FIG. 4, the cam follower 101 is made of a substantially U-shaped main body having two opposed sidewalls 102 interconnected by a pallet 106 disposed at a lower portion. The lower pallet 106 preferably has a groove 106*a* formed along a bottom surface thereof for engagement with the upper end of the valve stem. As shown in FIG. 3 a roller is disposed between and rotatably mounted to the sidewalls 102 as is known in the art.

Figure 4:
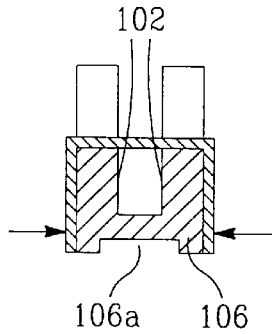
FIG. 4 is a sectional view taken along lines 4—4 of FIG. 3 without the roller.

As can be seen in FIGS. 3 & 4, the clamp 120 is made of an inverted substantially U-shaped channel member pressed over the end 108 of the follower 101. The clamp 120 is dimensioned to provide a compression force through the lower portion of the cam follower 1 and through the pallet 106 as indicated by the arrows in each of FIG. 4. Fatigue failure is associated with tensile forces. Therefore, by inducing a compression force through the lower pallet 106, increased fatigue life is achieved. Furthermore, the clamp 120 arrangement provides for an overall stiffer follower device. The clamp 120 is preferably a one-piece stamped member formed of the same metal used to form the main body of the cam follower 101. However, other materials, such as strong plastics may be employed so long as compressive forces are induced in the lower pallet 106.

Fatigue failure of the cam follower 1 and lower portion 6 is often associated with the end 108 adjacent the valve stem. Therefore, it is preferred to employ the clamp member 120 adjacent the end 108 of the cam follower that engages the upper end of the valve stem. Of course, the clamp member 120 may be employed at the opposite end 110 or a clamp member provided at both ends to enhance the overall stiffness of the cam follower.

Figure 5:
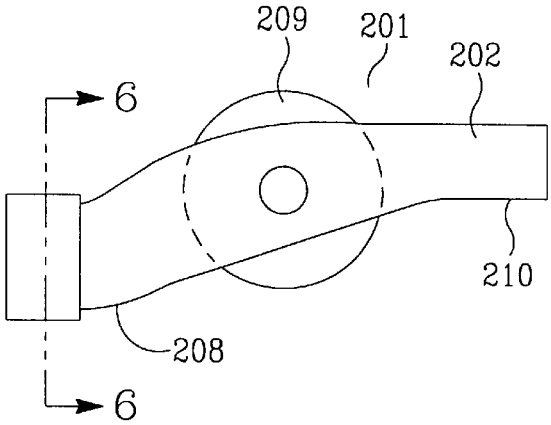
FIG. 5 is an isolated side view of the cam follower according to an alternate embodiment of the present invention.
Figure 6A:
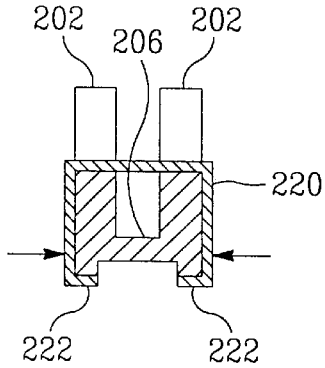
FIG. 6A is a sectional view taken along lines 6—6 of FIG. 5 without the roller.
Figure 6C:
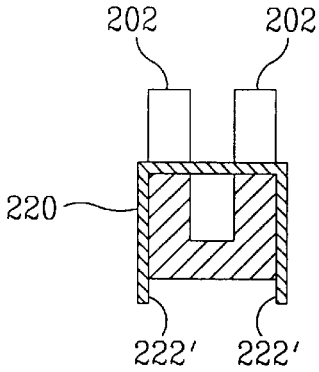
FIG. 6C is a sectional view of an additional alternate form of the cam follower of FIG. 6A.
Figure 6B:
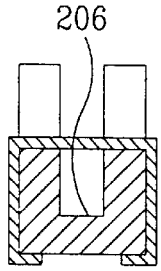
FIG. 6B is a sectional view of an alternate form of the cam follower of FIG. 6A.

FIGS. 5–6A&B&C represent an alternate embodiment of the present invention. In the alternate embodiment, clamp member 220 simply includes an additional extension 222 extending inward and underneath the pallet 206 terminating adjacent the groove 206*a*. However as can be seen in FIGS. 6B, 6C the necessity of groove 206*a* can be eliminated by utilizing the extensions 222 as the guide walls. The extension 222 increases the height of the clamp 220 and provides increased guidance for engagement with the upper end of the valve stem. Such an arrangement also increases the stability of the cam follower 202 valve stem interface that is particularly beneficial during assembly of the cylinder head components. As shown in FIG. 6*c* the extensions 222' may extend beyond the side walls 202 to form opposing valve guide walls.

The main body of the follower 101,201 is preferably stamped from a single sheet of steel to form a one-piece body which is then heat treated. However cast or net formed followers may similarly be employed. The clamp 120,220 may be similarly stamped.

As depicted in each of FIGS. 3–8, the cam follower 101,201 of the preferred embodiment comprises an upward extending U-shaped member and the clamp 120,220 is a downward extending U-shaped member disposed over the cam follower 101,201. However, it is to be understood that the cross section of the main body of the cam follower could be an inverted U-shaped member or H-shaped member. The clamp member would then be suitably shaped to induce compression through the connecting pallet member 106,206.

Figure 7:
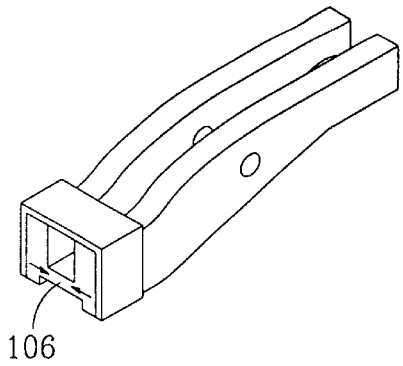
FIG. 7 is an elevated perspective view of the cam follower and clamp of FIG. 3 without the roller.
Figure 8:
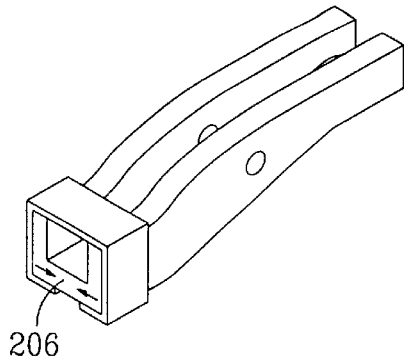
FIG. 8 is an elevated perspective view of the cam follower and clamp of FIG. 5 without the roller.

FIGS. 7–8 simply represent an elevated perspective view of the cam follower and clamp device of the embodiments of FIGS. 3,4 and 5,6A respectively. The arrows indicate the induced compression forces through the lower pallet 106, 206.

Figure 9A:
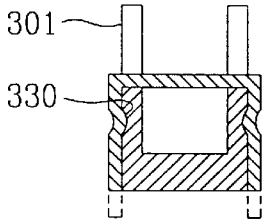
FIG. 9A is a sectional view of an alternate embodiment of the present invention.
Figure 9B:
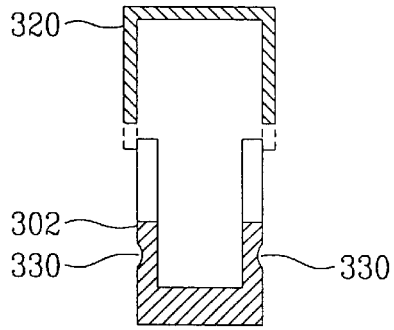
FIG. 9B is an exploded sectional view of the embodiment of FIG. 9A.

FIGS. 9A&9B represent an alternative method of securing the clamp 320 to the follower 301. In this embodiment, a dimple or detent 330 is formed on each side wall 302. The clamp 320 is then simply fitted over the follower and crimped or otherwise deformed to engage the dimple to retain the clamp to the pallet. In an alternate embodiment, the clamp 320 may be pre-deformed and installed on the follower in a snap fit fashion. In yet another embodiment, the side walls of the follower and inner surface of the clamp may be formed with corresponding barbed like retention members to facilitate a snap fit fashion. In such an instance either the side walls or the inner surface of the clamp may be formed with a plurality of corresponding projections and recesses as will be appreciated within the art. The side walls of the clamp 320 may also be extended to act as valve guide walls to improve stability during engine assembly and operation.

Figure 10:
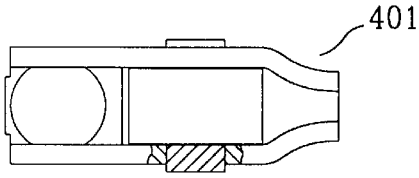
FIG. 10 is a top view of an alternate follower to which the clamp of the present invention may be employed.
Figure 11:
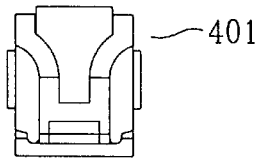
FIG. 11 is a front view of the follower of FIG. 10.
Figure 12:
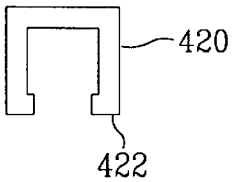
FIG. 12 is a front view of an alternate clamp to be employed with the follower of FIG. 10.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined by the appended claims. For example, the present invention is not limited to the fold up type follower depicted in FIGS. 1–9. The present invention may similarly be adapted and dimensioned to accommodate other types of followers, Specifically, FIGS. 10–11 represent an alternative follower 401. As shown in FIG. 12 an inverted U-clip 420 has tabs 422 that snap over the follower 401 of FIGS. 10–11 to facilitate a simple installation. Further embodiments of the present invention are shown in FIGS. 13 and 14A–14B.

Figure 13:
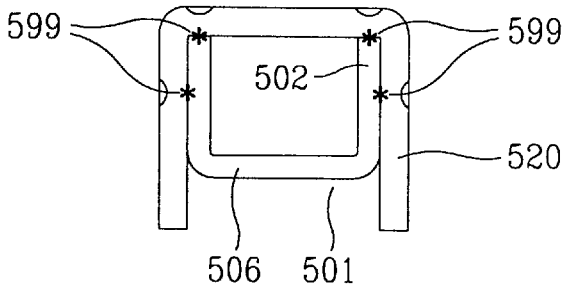
FIG. 13 is a front view of an alternate embodiment of the present invention.
Figure 14A:
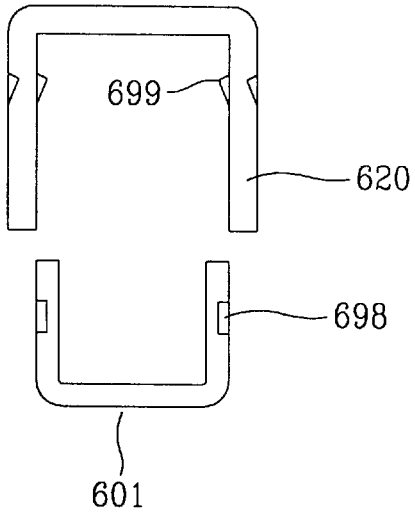
FIG. 14*a* is a front exploded view of an alternate embodiment of the present invention.
Figure 14B:
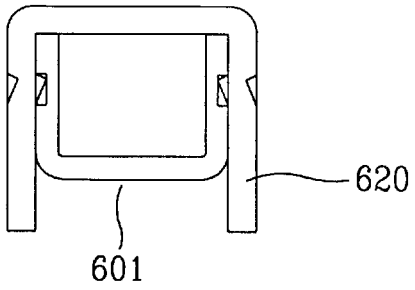
FIG. 14*b* a front view of the assembled embodiment of FIG. 14*a*.

FIG. 13 depicts a U-shaped clamp 520 which is spot welded at points 599 to the side walls 502 of the cam follower 501, The side walls of the clamp 520 extend past the pallet 506 to provide improved stability during installation of the valve assembly or engine operation. FIGS. 14A–14*b* show a similar arrangement wherein the clamp 620 is secured to the sidewalls of cam follower 601 having a preformed coined recess 698 formed in the sidewall to accommodate a lance 699 formed in the clamp 620. FIGS. 14A depicts an exploded view of the clamp 620 and cam follower 601 in a pre-assembled state. FIG. 14B depicts the clamp 620 and cam follower 601 in an assembled stated, The clamp 620 is simply forced over the cam follower 601 in a snap fit fashion.

What is claimed is:

1. A cam follower comprising:

a main body extending from a first end adapted to be pivotally supported on a portion of an internal combustion engine to a second end adapted to engage a valve stem, said main body including:

a pair of spaced apart opposing sidewalls extending from said first end to said second end;

a pallet interconnecting said sidewalls adjacent at least one of said first and second ends; and at least one clamp disposed about said side walls adjacent said pallet and inducing a compressive force in said pallet.

2. The cam follower according to claim 1, wherein said main body is formed as a one-piece stamped piece of metal.

3. The cam follower according to claim 1, wherein said follower further comprises a roller disposed between and rotatably mounted to said sidewalls to rollingly engage a camshaft.

4. The cam follower according to claim 1, wherein said main body is a unitary body having a substantially U-shaped cross section and said pallet is disposed adjacent a lower portion of each of said side walls.

5. The cam follower according to claim 4, wherein said clamp comprises an inverted substantially U-shaped channel member disposed about said side walls and said pallet adjacent said second end.

6. The cam follower according to claim 1, wherein said pallet is disposed adjacent said second end of said follower, said clamp comprising an inverted substantially U-shaped channel member disposed about said side walls and said pallet, said clamp having an extension extending inward and underneath said pallet.

7. The cam follower according to claim 6, wherein said pallet and has a groove formed on a bottom surface thereof to engage said valve stem and said extension of said clamp terminated adjacent said groove.

8. The cam follower according to claim 1, wherein a recess is formed on an external surface of at least one of said side walls, said clamp being deformed to engage said recess to facilitate retention of said clamp to said main body of said follower.

9. The cam follower according to claim 1, wherein said pallet is disposed adjacent said second end of said follower, said clamp comprising an inverted substantially U-shaped channel member disposed about said side walls and said pallet, said clamp having a portion extending beyond said walls to form opposing valve guide walls.

* * * * *